US006745731B2

(12) United States Patent
Tanaka et al.

(10) Patent No.: US 6,745,731 B2
(45) Date of Patent: Jun. 8, 2004

(54) VALVE DRIVING DEVICE OF AN INTERNAL COMBUSTION ENGINE

(75) Inventors: Tsuneo Tanaka, Fujisawa (JP); Akihiko Minato, Fujisawa (JP); Yoshihiro Arakawa, Sagamihara (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 10/437,848

(22) Filed: May 14, 2003

(65) Prior Publication Data

US 2003/0213446 A1 Nov. 20, 2003

(30) Foreign Application Priority Data

May 15, 2002 (JP) ..... 2002-140438

(51) Int. Cl.[7] ..... F01L 9/02
(52) U.S. Cl. ..... 123/90.12
(58) Field of Search ..... 123/90.12, 90.13; 137/1; 251/30.01, 63.6

(56) References Cited

U.S. PATENT DOCUMENTS 6,067,946 A * 5/2000 Bunker et al. ..... 123/90.12

FOREIGN PATENT DOCUMENTS

| | | |
|---|---|---|
| JP | 63-109213 | 5/1988 |
| JP | 64-069707 | 3/1989 |
| JP | 2001-280109 | 10/2001 |

* cited by examiner

*Primary Examiner*—Thomas Denion
*Assistant Examiner*—Zelalem Eshete
(74) *Attorney, Agent, or Firm*—McCormick, Paulding & Huber LLP

(57) ABSTRACT

A valve driving device reduces the volume of the pressure chamber and decreases the energy supplied during driving to open the main valve. As a result of this initial energy, the main valve is lifted by inertial motion. When the main valve is opened (lifted), a first actuating valve is opened, and high-pressure actuating fluid is supplied to the pressure chamber. When in this process the pressure in the pressure chamber falls below the pressure of a low-pressure chamber, a second actuating valve opens independently, and low-pressure actuating fluid is introduced into the pressure chamber. By this means negative pressure in the pressure chamber can be prevented, and the main valve can be held in a lift position equivalent to the initial energy. When the main valve is to be closed, an actuator forcibly opens the second actuating valve. Then, high-pressure actuating fluid in the pressure chamber passes through the second actuating valve, presses and opens a third actuating valve on the downstream side, and is discharged to a path.

4 Claims, 9 Drawing Sheets

FIRST ACTUATING VALVE COMMAND PULSE

BALANCE VALVE OPENING

PRESSURE IN PRESSURE CHAMBER

SECOND ACTUATING VALVE OPENING

THIRD ACTUATING VALVE OPENING

MAIN VALVE LIFT

VALVE DRIVING DEVICE OF AN INTERNAL COMBUSTION ENGINE

REFERENCE TO RELATED APPLICATION

The present invention claims priority from Japanese Patent Application 2002-140438 filed in Japan on May 15, 2002. The content of this Japanese application is hereby incorporated in the specification of the present application by reference.

BACKGROUND OF THE INVENTION

1. Field of the Invention

This invention relates to a valve driving device of an internal combustion engine, and in particular to a device which performs opening and closing of a valve system using fluid pressure, without having a cam mechanism.

2. Description of the Related Art

So-called camless valve driving devices, which eliminate cams for valve driving and instead employ electromagnetic driving or hydraulic driving of the valve in order to enhance freedom of engine control, are viewed as promising. Such technology is disclosed in Japanese Patent Publication No. 7-62442 and in Japanese Patent No. 2645482, wherein the valve opening and closing timing and lift amount of the device can be set freely.

In such a device, high fluid pressure is developed sufficient to lift the valve by the necessary amount in opposition to the valve spring, and this pressure is applied to the valve to perform the desired lifting. However, a large amount of energy is required for valve driving to simply apply high fluid pressure to the valve, the valve driving loss is increased, and there is the disadvantage that a decrease in fuel efficiency may result.

In order to resolve this problem, the inventors newly invented a valve driving device of an internal combustion engine which utilizes low-pressure fluid to greatly reduce the valve driving energy. In this device, a pressure chamber to which is supplied actuating fluid to open the valve is connected to three passages, which are a passage to supply high-pressure actuating fluid, a passage to introduce low-pressure actuating fluid, and a passage to discharge actuating fluid from the pressure chamber; valves are provided in each passage.

However, in this structure the volume of the pressure chamber is necessarily large, and energy must be supplied through high-pressure actuating fluid to the pressure chamber when performing driving to open the valve. Hence the fraction of available energy which is the fraction of conversion into kinetic valve energy relative to the energy supplied during the valve opening is reduced, the valve driving energy is increased, and worsened output and fuel efficiency may result.

SUMMARY OF THE INVENTION

The present invention was devised in light of the above problems, and has as an object the provision of a valve driving device of an internal combustion engine in which the volume of the pressure chamber is reduced insofar as possible and the energy supplied during driving to open the valve is decreased, while at the same time the available energy fraction is increased, valve driving energy is reduced, and output and fuel efficiency are raised.

This invention is a valve driving mechanism to drive the opening and closing of a main valve serving as an intake valve or as an exhaust valve of an internal combustion engine, and comprises a pressure chamber, to which is supplied pressurized actuating fluid to open the above main valve; a high-pressure actuating fluid supply source, connected to the above pressure chamber; a low-pressure actuating fluid supply source, connected to the above pressure chamber; a first actuating valve, provided between the above pressure chamber and the above high-pressure actuating fluid supply source, which is opened for a prescribed period in the initial opening period of the above main valve, and which supplies high-pressure actuating fluid from the above high-pressure actuating fluid supply source to the above pressure chamber; a second actuating valve, comprising a check-valve provided between the above pressure chamber and the above low-pressure actuating fluid supply source, which, after the prescribed interval in the initial opening period of the above main valve has elapsed, is opened when the pressure of the above pressure chamber is lower than the pressure of the above low-pressure actuating fluid supply source based on the pressure difference therebetween, to introduce low-pressure actuating fluid from the above low-pressure actuating fluid supply source into the above pressure chamber; a third actuating valve comprising a check-valve, provided either between the above second actuating valve and the above low-pressure actuating fluid supply source or in the above low-pressure actuating fluid supply source, which is opened when the intake-side pressure becomes higher than the pressure of the above low-pressure actuating fluid supply source and also higher than a prescribed pressure setting which is lower than the pressure of the above high-pressure actuating fluid supply source, and by this means discharges actuating fluid from the above pressure chamber; and, an actuator which forcibly opens the above second actuating valve during opening of the above main valve.

It is preferable that the above third actuating valve be provided between the above second actuating valve and the above low-pressure actuating fluid supply source, that the second actuating valve and third actuating valve be comprised by a single valve unit, and that the above low-pressure actuating fluid supply source be connected to the above valve unit.

It is also preferable that the above second actuating valve comprises a valve body movable in the axis direction, that poppet valve portion which receives the pressure on the side of the above pressure chamber and is impelled to the closed-valve side is provided at one end of this valve body, and that the above actuator comprise an electrical actuator which when turned on impels the other end of the above valve body to drive the above valve body to the open-valve side.

It is also preferable that a valve stopper be provided to set a maximum opening for the above second actuating valve.

In a preferred aspect of this invention, when the main valve is opened (lifted), the first actuating valve is open and high-pressure actuating fluid is supplied to the pressure chamber. By this means initial energy is provided to the main valve, and thereafter the valve is lifted by inertial motion. In this process, when the pressure of the pressure chamber falls below the pressure of the low-pressure actuating fluid supply source, the second actuating valve opens independently, and low-pressure actuating fluid is introduced into the pressure chamber. By this means a large amount of actuating fluid is supplied to the pressure chamber, exceeding the amount of high-pressure actuating fluid supplied, so that there is never negative pressure in the pressure chamber, the main valve can be held in the valve lifted position reached by the above-described initial energy, and the driving energy used during main valve lifting can be reduced.

When the main valve is closed, the second actuating valve is forcibly opened by the actuator. Then, after the high-pressure actuating fluid in the pressure chamber passes through the second actuating valve, the third actuating valve on the downstream side is pushed open, and the high-pressure actuating fluid is discharged to the outside. By this means the pressure in the pressure chamber falls and the main valve is closed.

DESCRIPTION OF THE PREFERRED EMBODIMENTS

Below, preferred aspects of the invention are explained, based on the attached drawings.

Figure 1:
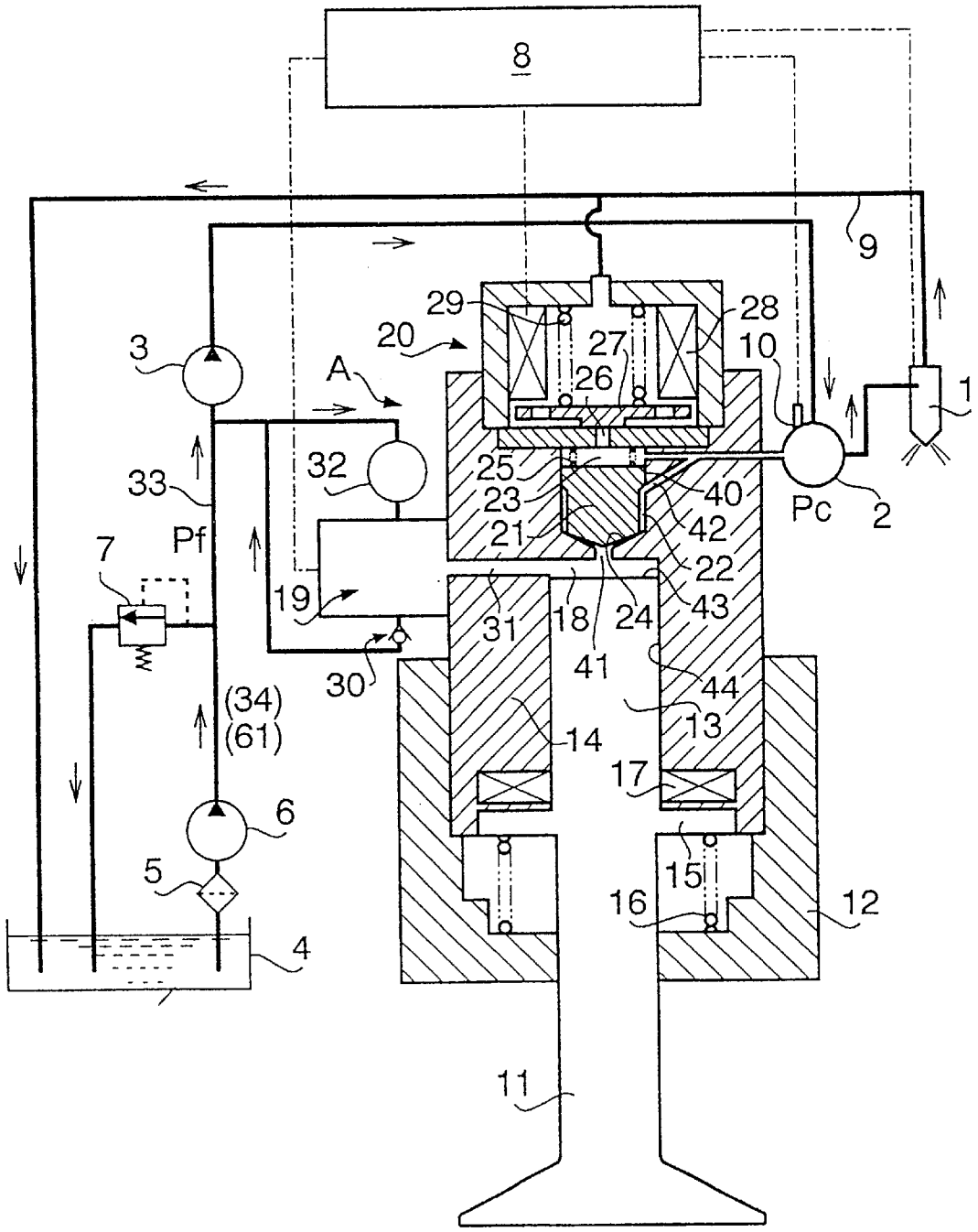
FIG. 1 is an overall view of a valve driving device of an aspect of this invention.

FIG. 1 shows an overall view of a valve driving device of an aspect of this invention. This aspect is an example of application to a multicylinder common-rail diesel engine for vehicular and other uses. First a common-rail fuel-injection device is explained. An injector 1 which executes fuel injector into each cylinder of the engine is provided, and high-pressure fuel at a common-rail pressure Pc (from several tens to several hundreds of MPa), stored in a common rail 2, is constantly supplied to the injector 1. Pressurized transport of fuel to the common rail 2 is performed by the high-pressure pump 3, and after fuel from the fuel tank 4 is suctioned out by the feed pump 6 via the fuel filter 5, it is sent to the high-pressure pump 3. The feed pressure Pf of the feed pump 6 is adjusted using a relief valve consisting of a pressure adjustment valve 7, and is held constant. The feed pressure Pf is higher than atmospheric pressure (that is, the fuel is in a pressurized state), but is markedly lower than the common rail pressure Pc, at for example a value of 0.5 MPa.

An electronic control unit (hereafter "ECU") 8 is provided as a control device for comprehensive control of the entire apparatus shown, and is connected to sensors (not shown) which detect the engine operating state (engine crank angle, rotation speed, engine load, and similar). The ECU 8 determines the engine operating state based on signals from these sensors, and based on this sends driving signals to the electromagnetic solenoid of the injector 1 to control the opening and closing of the injector 1. Fuel injection is executed or halted according to whether the electromagnetic solenoid is on or off. When injection is halted, fuel at approximately normal pressure is returned from the injector 1 to the fuel tank 4 via the return path 9. The ECU 8 performs feedback control to move the actual common rail pressure toward a target pressure, based on the engine operating state. To this end, a common rail pressure sensor 10 to detect the actual common rail pressure is provided.

Next, a valve driving device of this invention is explained. 11 is the main valve serving as an intake or exhaust valve for the engine. The main valve 11 is supported, in a manner enabling free rising and falling, by the cylinder head 12, and the upper end of the main valve 11 is integrated with the piston 13. That is, the piston 13 is linked integrally to the main valve 11. A main valve driving actuator A serving as the principal component of this device is provided on the upper portion of the main valve 11, and the actuator body 14 thereof is fixed on the cylinder head 12. The piston 13 is capable of vertical sliding within the actuator body 14. The example shown is of a single main valve for a single cylinder, but when opening and closing control is to be performed for numerous cylinders or for numerous main valves, these valves may be provided with the same configuration. In this aspect, the main valve 11 and piston 13 are formed integrally, but may be configured as separate members.

A flange portion 15 is provided in the main valve 11, and a valve spring 16 which impels the main valve 11 toward the closed position (upward in the figure) is arranged, in a compressed state, between the flange portion 15 and cylinder head 12. Here, the valve spring 16 comprises a coil spring. A magnet 17 which draws the flange portion 15 is embedded within the actuator body 14, and by this means also the main valve 11 is impelled toward the closed position. Here, the magnet 17 is a permanent magnet in a ring shape so as to surround the main valve 11. The piston 13 comprises at least the portion at the upper end of the main valve 11, and is inserted into the actuator body 14 while forming a shaft seal.

A pressure chamber 18 facing the upper-end face (that is, the pressure-receiving face 43) of the piston 13 is formed by partitioning within the actuator body 14. The pressure chamber 18 is supplied with pressurized actuating fluid in order to open the main valve 11, and is formed by partitioning with the pressure-receiving face 43 as the bottom face portion. As the actuating fluid, a light oil, which is also employed as the engine fuel, is used. When high-pressure fuel is supplied to the pressure chamber 18, the main valve 11 is pressed in the open position (downward in the drawing), and when this pressing force exceeds the impelling force of the valve spring 16 and magnet 17, the main valve 11 is opened downward (lifted). On the other hand, when high-pressure fuel is discharged from the pressure chamber 18, the main valve 11 is closed.

The pressure chamber 18 comprises a piston insertion hole 44 of circular cross-sectional shape and fixed radius, formed mainly within the actuator body 14; the piston 13 is slidably inserted into the piston insertion hole 44. During the period when the main valve 11 changes from fully closed to fully open, the piston 13 never leaves (is never removed from) the piston insertion hole 44, and the piston 13 is always in contact with the inner face of the piston insertion hole 44. In other words, during the period when the main valve 11 changes from fully closed to fully open, the ratio of the amount of increase in volume of the pressure chamber 18 to the amount of movement of the piston 13 is held constant.

Above the pressure chamber 18 is provided a first actuating valve 20 to switch between supplying and halting the supply of high-pressure fuel to the pressure chamber 18. In this aspect, the first actuating valve 20 comprises a pressure-balanced control valve.

The first actuating valve 20 has a needle-shaped balance valve 21 positioned coaxially with the main valve 11. A shaft sealing portion 40 is formed on the upper end of the balance valve 21, and a supply passage 22 and valve control chamber 23 are formed by partitioning below the shaft sealing portion 40 and above the shaft sealing portion 40, respectively. The upper-end face of the balance valve 21 is a face to receive the pressure of fuel within the valve control chamber 23. The supply passage 22 and valve control chamber 23 are connected to the common rail 2 as a high-pressure actuating fluid supply source, via a branch passage 42 formed within the actuator body 14 and an external pipe, and are constantly supplied with high-pressure fuel at the common rail pressure Pc. As is seen below, lifting of the main valve 11 occurs due to high-pressure fuel at this common rail pressure Pc.

The supply passage 22 is linked to the pressure chamber 18 facing the lower side of the balance valve 21, and midway has a valve seat 24 which makes linear or plane contact with the lower-end conical face of the balance valve 21. An outlet 41 of the supply passage 22 (that is, an inlet for high-pressure fuel to the pressure chamber 18) is provided on the downstream side (the lower side in the drawing) of the valve seat 24. This outlet 41 is positioned coaxially with the main valve 11, is directed toward the pressure-receiving face of the piston 13, and is directed in the direction of movement or the axial direction of the main valve 11 or the piston 13. The pressure-receiving face 43 is a round-shaped surface perpendicular to the axial direction.

A spring 25 which impels the balance valve 21 in the closed direction (the lower side in the drawing) is provided in the valve control chamber 23. The spring 25 comprises a coil spring, inserted into and positioned in a compressed state in the valve control chamber 23. The valve control chamber 23 is linked to the return path 9 via the orifice 26, which is a fuel outlet. An armature 27 is provided, in a manner enabling vertical motion, above the orifice 26 as an on-off valve which opens and closes the orifice; above the armature 27 are provided an electromagnetic solenoid 28 as an electrical actuator and an armature spring 29, which drive the rising and falling (opening and closing) thereof. The electromagnetic solenoid 28 is connected to the ECU 8, and is turned on and off by signals, that is, command pulses, applied by the ECU 8.

Normally when the electromagnetic solenoid 28 is off, the armature 27 is pressed downward by the armature spring 29, and the orifice 26 is closed. On the other hand, when the electromagnetic solenoid 28 is turned on, the armature 27 rises in opposition to the impelling force of the armature spring 29, and the orifice 26 is opened.

On the other hand, one end of the passage 31 formed within the actuator body 14 is connected to the pressure chamber 18. The other end of the passage 31 is connected to a valve unit 19 provided on the outer side of the actuator body 14. A low-pressure chamber 32 is connected, as a low-pressure actuating fluid supply source having prescribed volume, to the valve unit 19. As a result, the low-pressure chamber 32 is connected to the pressure chamber 18 via a passage within the valve unit 19 and the passage 31 within the actuator body 14.

The low-pressure chamber 32 is connected to the feed path 33 which is on the downstream side of the pressure adjustment valve 7 and on the upstream side of the high-pressure pump 3, and is constantly supplied with and stores low-pressure fuel at feed pressure Pf from the feed path 33.

Figure 2:
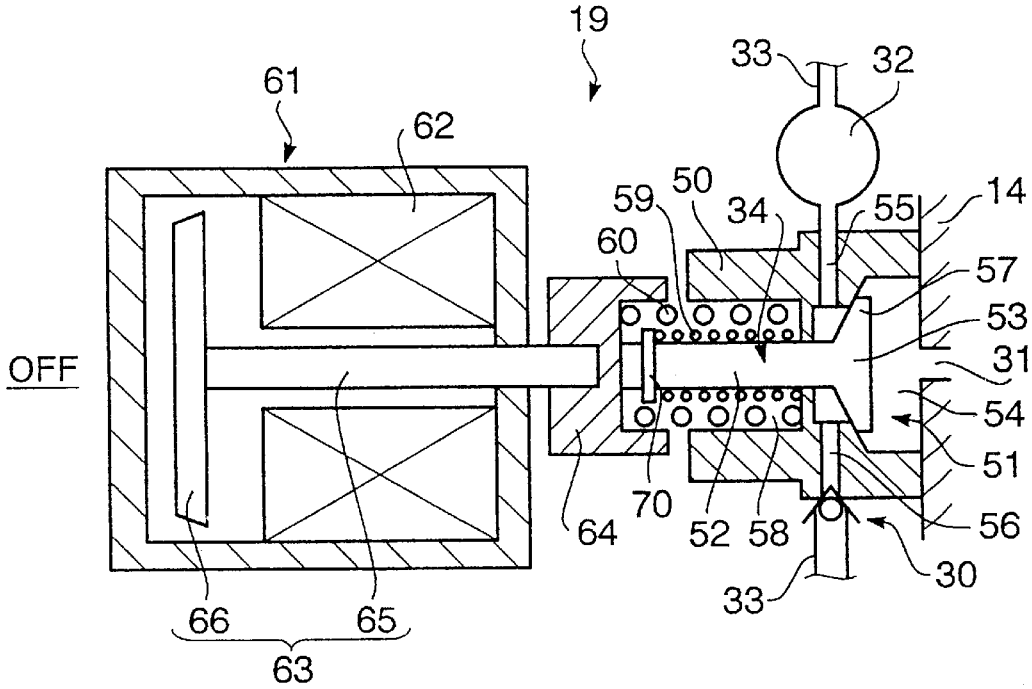
FIG. 2 is a cross-sectional view of principal components of a valve unit, in which the electromagnetic solenoid is in the normal or off state.

The details of the valve unit 19 are shown in FIG. 2. The valve unit 19 has a valve stopper 50 mounted on the fixed side, for example, on the actuator body 14; the valve stopper 50 is provided with a fluid passage 51 to connect the passage 31 and the low-pressure chamber 32. The fluid passage 51 comprises a valve chamber 54 to accommodate the poppet valve portion 53 of the valve body 52, a first passage 55 to connect the valve chamber 54 and the low-pressure chamber 32, and a second passage 56 to connect the valve chamber 54 and feed path 33.

The valve body 52 is formed in a shaft shape overall, with an poppet valve portion 53 formed on the tip portion (the right end in the drawing), and is capable of motion in the axial direction (the horizontal direction in the drawing). By means of axial-direction motion, the rear face of the poppet valve portion 53 is seated on and moves away from the seat portion 57 formed in the valve stopper 50, so that the intermediate position of the valve chamber 54 opens and closes. A spring chamber 58 is also formed in the valve stopper 50; the valve body 52 is moveably positioned in the center portion of this spring chamber 58, and first and second return springs 59, 60 are provided on the inside and outside perimeters of the spring chamber 58. The first return spring 59 comprises a coil spring with a comparatively small set force and spring constant, is mated with the outer perimeter of the valve body 52, and presses against the base end of a spring seat 70 provided integrally at the base end (the left end in the drawing) of the valve body 52, to constantly impel the valve body 52 toward the closed position. By means of the valve body 52, seat portion 57 and first return spring 59 and similar, a second actuating valve 34 is configured as a mechanical check-valve.

A third actuating valve 30, comprising a mechanical check-valve, is provided in the second passage 56. In the third actuating valve 30, the side of the second passage 56 is the inlet side, and the side of the feed path 33 is the outlet side. The third actuating valve 30 opens based on the pressure difference between the inlet side and outlet side, and closes only when the pressure on the inlet side is higher by a prescribed pressure difference than the pressure on the outlet side.

An electrical actuator, which in this aspect is an electromagnetic actuator 61, to forcibly open the second actuating valve 34 is provided. The electromagnetic actuator 61 comprises an electromagnetic solenoid 62 which is turned on and off by signals, that is, by command pulses, sent from the ECU 8 provided on the fixed side; an armature 63 which moves in the coaxial direction (the horizontal direction in the drawing) with the valve body 52 in response to the turning on and off of the electromagnetic solenoid 62; a spring seat 64, provided integrally with the tip portion of the armature 63 and having a closed-end cylindrical shape capable of contact with the base end face of the valve body 52; and, a second return spring 60 which impels the spring seat 64 and armature 63 to the return position or the closed-position side (the left side in the drawing).

Figure 4:
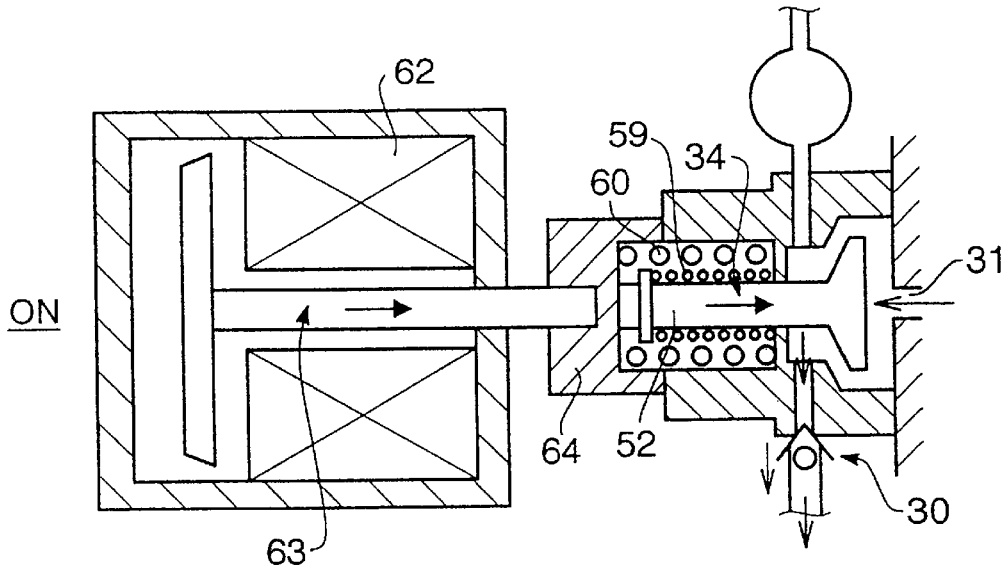
FIG. 4 is a cross-sectional view of principal components of a valve unit, in the high-pressure discharge state.

The armature 63 comprises a shaft portion 65 which is surrounded by and passes through the center portion of the electromagnetic solenoid 62, and a magnetic action plate 66 provided integrally with the base end of the shaft portion 65. FIG. 2 shows the state in which the electromagnetic solenoid 62 is turned off. On the other hand, when as shown in FIG. 4 the electromagnetic solenoid 62 is turned on, the armature 63 moves to the closed side (the right side in the drawing), the spring seat 64 presses and moves the valve body 52 to the open side in opposition to the impelling force of the first and second return springs 59 and 60, and the second actuating valve 34 is forcibly opened. At this time the maximum opening, or the open-valve stroke of the valve body 52, is determined by contact of the spring seat 64 with the valve stopper 50. This stroke amount is, for example, 0.3 mm. The second return spring 60 comprises a coil spring with a comparatively large set force and spring constant.

Here, the open-valve pressure setting of the third actuating valve 30 is somewhat higher than the feed pressure Pf, and markedly lower than the common rail pressure Pc. Hence even if low-pressure fuel exists in the inlet of the third actuating valve 30, the third actuating valve 30 does not open (see FIG. 2), but if high-pressure fuel exists at the inlet of the third actuating valve 30, the third actuating valve 30 immediately opens (see FIG. 4). Also, the open-valve pressure setting of the second actuating valve 34 is a low value, and in effect, when the pressure on the rear-face side of the poppet valve portion 53 becomes higher than the pressure on the front-face side, the second actuating valve 34 opens (see FIG. 3).

Opening and closing of the second actuating valve 34 is performed by seating and removing the poppet valve portion 53 and seat portion 57, and so if this seating portion is effectively regarded as the second actuating valve 34, then the third actuating valve 30 is provided between the second actuating valve 34 and the low-pressure chamber 32.

Next, the action of this aspect is explained.

First, the action of the first actuating valve 20 is explained. In the state of FIG. 1, the electromagnetic solenoid 28 is turned off and the orifice 26 is closed by the armature 27; in addition, the balance valve 21 is seated in the valve seat 24, in the valve-closed state. At this time, the balance valve 21 receives pressure due to the high-pressure fuel in the downward and upward directions from the upper-side valve control chamber 23 up to the shaft seal portion 40, and from the lower-side supply passage 22, respectively. However, because the balance valve 21 is seated in the valve seat 24, the surface area of the surface receiving downward pressure is markedly larger than the surface area of the surface receiving upward pressure, and moreover the balance valve 21 is also pushed downward by the spring 25, so that the balance valve 21 is pressed downward hard against the valve seat 24.

Next, when the electromagnetic solenoid 28 is turned on, the armature 27 rises and the orifice 26 opens, the valve control chamber 23 goes to low pressure due to the discharge of fuel, and as a result the upward force on the balance valve 21 exceeds the downward force, and the balance valve 21 rises. Consequently the outlet 41 of the supply passage 22 is opened, and high-pressure fuel is vigorously supplied to the pressure chamber 18 via the outlet 41 of the supply passage 22.

Next, when the electromagnetic solenoid 28 is turned off, the armature 27 falls and the orifice 26 is closed, fuel discharge from the valve control chamber 23 is halted, and the pressure in the valve control chamber 23 gradually rises. In this process, before the balance valve 21 is seated in the valve seat 24, the downward pressure received by the balance valve 21 from the high-pressure fuel of the valve control chamber 23 and the upward pressure received by the balance valve 21 from the high-pressure fuel of the supply passage 22 are balanced, and so the balance valve 21 falls due solely to the downward force of the spring 25. However, once the balance valve 21 is seated in the valve seat 24, a state similar to the above-described closed state is created, the balance valve 21 is strongly pressed against the valve seat 24, and the outlet 41 of the supply passage 22 is closed.

Figure 8:
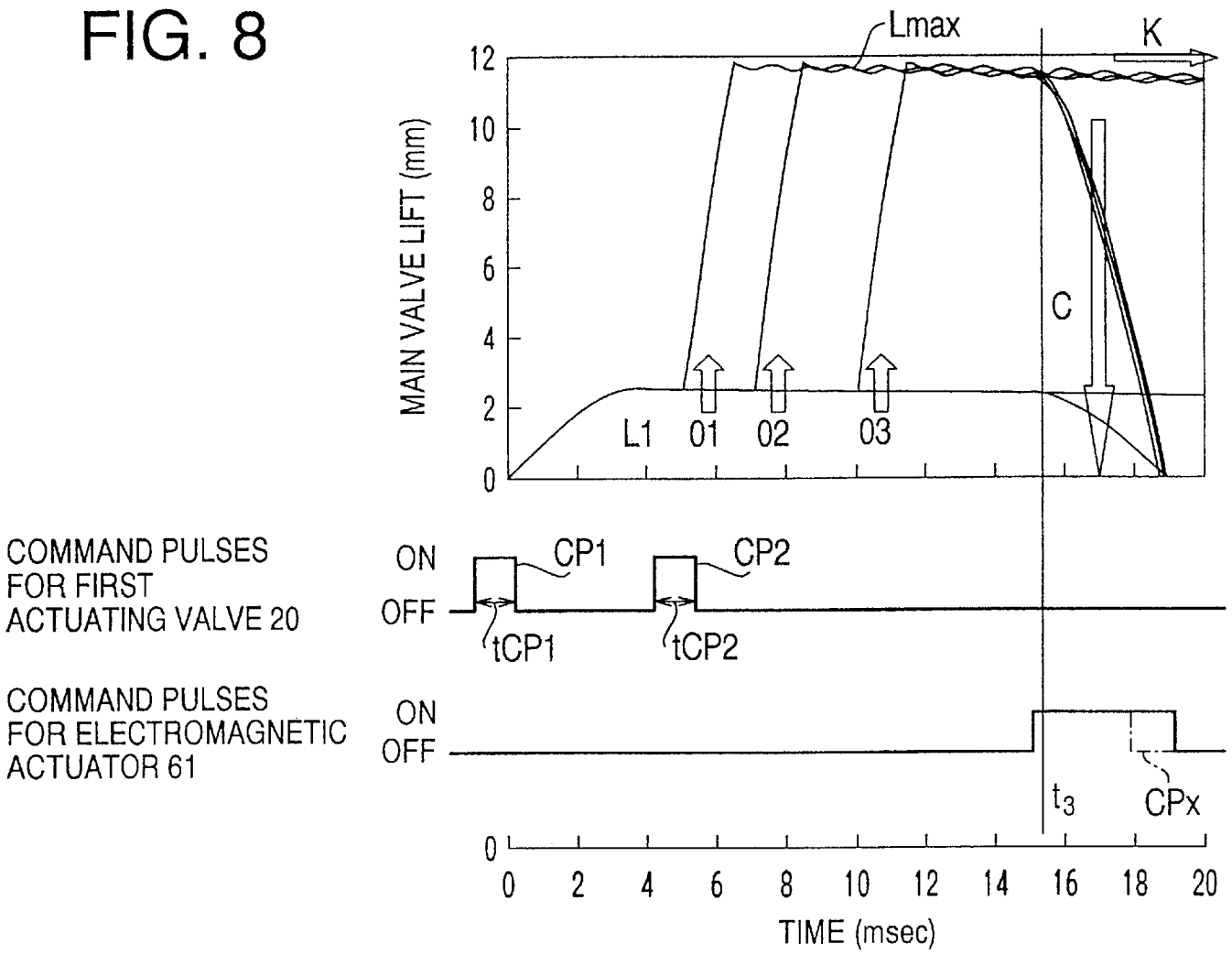
FIG. 8 is a time chart showing the details of valve control in this aspect.
Figure 9A:
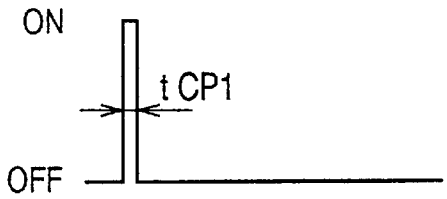
FIG. 9 is a time chart showing the operating state of each portion in the valve driving device of this aspect.
Figure 9B:
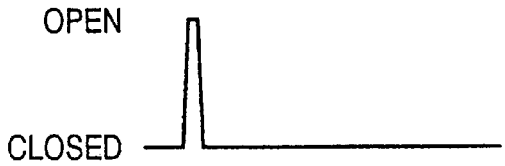
Figure 9C:
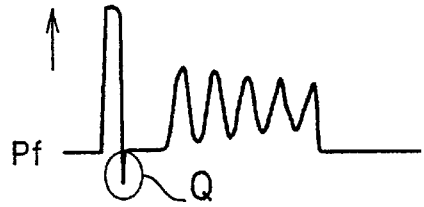
Figure 9D:
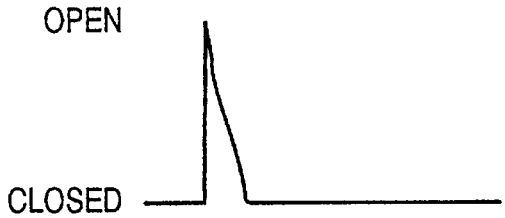
Figure 9E:
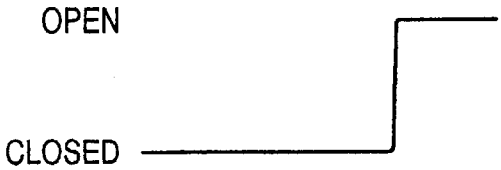
Figure 9F:
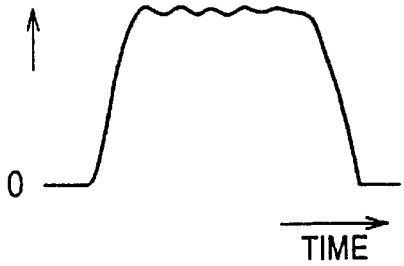

Next, the action of the valve driving device is explained. FIG. 8 shows the relation between command pulses sent from the ECU 8 and valve lifting. The upper area of the drawing shows the valve lifting (mm); the middle area of the drawing shows command pulses applied to the electromagnetic solenoid 28 of the first actuating valve 20 by the ECU 8; and the lower area of the drawing shows the command pulses applied to the electromagnetic solenoid 62 of the valve unit 19 by the ECU 8.

First, when the main valve 11 is opened (lifted) from the closed state, the electromagnetic solenoid 62 of the valve unit 19 is held in the off state, and the electromagnetic solenoid 28 of the first actuating valve 20 is turned on for a comparatively short prescribed interval tCP1 at a prescribed time, which takes actuation lag into account, prior to a prescribed valve opening initial period (the position of time "0" in FIG. 8), determined based on the engine operating state. In other words, the first actuating valve 20 is opened for a prescribed interval tCP1 at the initial period of opening of the main valve 11. Then the armature 27 in the first actuating valve 20 rises and the orifice 26 opens, high-pressure fuel in the valve control chamber 23 is discharged, the balance valve 21 rises, and the balance valve 21 is removed from the valve seat 24. By this means the supply passage 22 is opened, and high-pressure fuel is vigorously sprayed into the pressure chamber 18 from the outlet 41 of the supply passage 22. By means of this high-pressure fuel the pressure-receiving surface 43 of the piston 13 is pressed, so that initial energy is applied to the main valve 11, and thereafter, the main valve moves inertially and is lifted downward under the conditions of action by the valve spring 16 and magnet 17. The action to open the main valve 11 lags behind the supply of high-pressure fuel.

In the process of inertial motion of the main valve 11, the volume of the pressure chamber 18 increases gradually, but due to the fact that the motion of the main valve 11 is inertial motion due to high-pressure fuel at a pressure of several tens to several hundreds of MPa, the actual amount of volume increase of the pressure chamber is larger than the theoretical increase in volume of the pressure chamber 18 corresponding to the amount of high-pressure fuel supplied, and the pressure in the pressure chamber 18 falls below the pressure of the low-pressure chamber 32.

Figure 3:
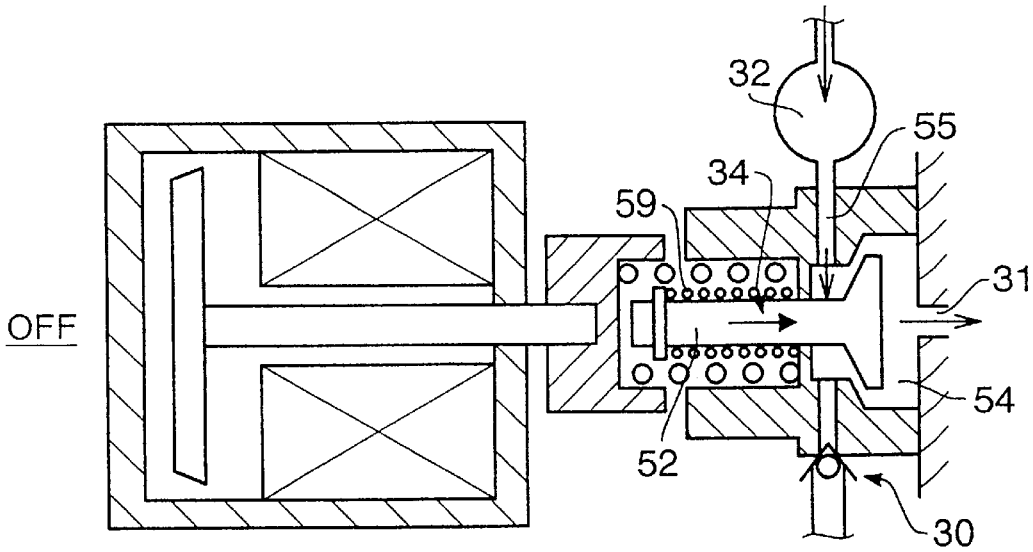
FIG. 3 is a cross-sectional view of principal components of a valve unit, in the low-pressure introduction state.

As a result of this pressure difference, as shown in FIG. 3, the valve body 52 of the second actuating valve 34 moves toward the valve-open side in opposition to the impelling force of the first return spring 59, and the second actuating valve 34 is opened. As a result the low-pressure fuel of the low-pressure chamber 32 is introduced into the pressure chamber 18 via the route comprising the first passage 55, valve chamber 54, and passage 31. In other words, fuel is replenished so as to compensate for the excessive increase in volume of the pressure chamber 18. By this means a larger amount of fuel is supplied to the pressure chamber 18, exceeding the amount of high-pressure fuel actually supplied, so that negative pressure in the pressure chamber 18 is avoided and main valve lifting action is stabilized, while at the same time the amount of main valve lifting can be held to a lift amount corresponding to the initial energy applied through the supply of high-pressure fuel. As a result, the driving energy required during main valve lifting can be reduced.

As shown in FIG. 3, the third actuating valve 30 is prevented from opening when low-pressure fuel is introduced. This is because the valve-opening pressure of the third actuating valve 30 is set somewhat higher than the feed pressure Pf. In the second actuating valve 34, a valve body 52 having an poppet valve portion 53 is used, so that as shown in FIG. 2, even if the front-face side (the right side in the drawing) of the poppet valve portion 53 receives the pressure of the high-pressure fuel from the pressure chamber 18 when the valve is open, the pressure causes the poppet valve portion 53 to be reliably pressed into the seat portion 57, so that fuel leakage from the pressure chamber 18 and reduction of pressure in the pressure chamber 18 are reliably prevented.

As shown in FIG. 8, after a first command pulse CP1 a second command pulse CP2 is applied to the electromagnetic solenoid 28 of the first actuating valve 20. That is, the first actuating valve 20 is also opened for the prescribed interval tCP2 in the midst of opening of the main valve 11, and the first actuating valve 20 is opened in two stages. By means of the inflow of high-pressure fuel and low-pressure fuel into the pressure chamber 18 resulting from the first command pulse CP1, the main valve 11 is temporarily held at an intermediate opening L1, and thereafter the main valve 11 is lifted to the maximum lifting position Lmax by the inflow of high-pressure fuel and low-pressure fuel into the pressure chamber 18 resulting from the second command pulse CP2, by a method similar to that described above. Through this two-stage main valve lifting, a lift curve approximating the case of ordinary cam driving can be obtained.

Next, when the main valve is to be closed, the first actuating valve 20 is held closed (the electromagnetic solenoid 28 is turned off), and the electromagnetic solenoid 62 of the valve unit 19 is turned on at a prescribed time, taking actuation delay into account, prior to a prescribed valve-closing initiation period (the position of time "t3") determined based on the engine operating state.

Then, as shown in FIG. 4, the valve body 52 of the second actuating valve 34 is impelled to the open-valve side by the armature 63 and spring seat 64, and the second actuating valve 34 is forcibly opened. With this, high-pressure fuel in the pressure chamber 18 passes through the route comprising the passage 31 and valve chamber 54 to reach the second passage 56, pressing and opening the third actuating valve 30, and is discharged into the feed path 33. The open-valve pressure of the third actuating valve 30 is set to a value lower than the high-pressure fuel pressure, that is, the common-rail pressure Pc, so that the third actuating valve 30 opens independently.

By this means, the pressure in the pressure chamber 18 falls, and the main valve 11 rises, that is, is closed, due to the impelling force of the valve spring 16 and magnet 17.

Thus in this device, by controlling the first actuating valve 20 and electromagnetic actuator 61, the main valve 11 can be opened and closed with any timing, independently of the engine crank angle. As indicated by O1, O2 and O3 in FIG. 8, by shifting the output time of the second command pulse CP2, the timing with which the main valve goes from the intermediate opening L1 to fully open Lmax can also be shifted. The same is true of the valve-closing timing. However, the example shown is of valve closing with fixed timing C. Through duty control of the electromagnetic actuator 61, the amount of high-pressure fuel flowing out from the pressure chamber 18 can be controlled and the speed at which the main valve 11 is closed can also be controlled. The electromagnetic actuator 61 can also be held in the off position to hold the main valve 11 fully open, as indicated by K.

And as indicated by the hypothetical line CPx, if the electromagnetic actuator 61 is turned off immediately before the main valve 11 is fully closed, the pressure in the pressure chamber 18 rises gradually from the time of being turned off, due to the closing action of the main valve 11, so that shocks and seating noise when the valve is seated can be mitigated.

FIG. 9 shows the action of each portion in the device of this aspect, from main valve opening to closing. In this example, as indicated in (a) in the drawing, a command pulse with prescribed interval tCP1 is applied to the first actuating valve 20 only in the initial opening period of the main valve, so that the first actuating valve 20 is opened.

When a command pulse is applied to the first actuating valve 20 ((a) in the drawing), the balance valve 21 opens ((b)), and the pressure inside the pressure chamber 18 instantly rises due to the inflow of high-pressure fuel ((c)). By this means, opening of the main valve 11 is begun after a prescribed time from the occurrence of the command pulse ((f)). The first actuating valve 20 is turned off for a short period, and at the same time the balance valve 21 is closed, so that the supply of high-pressure fuel to the pressure chamber 18 is halted; but because the main valve 11 is undergoing inertial motion, the main valve 11 does not stop immediately, and consequently an increase in the volume of the pressure chamber 18 greater than that corresponding to the amount of inflow of high-pressure fuel occurs, so that the pressure in the pressure chamber 18 momentarily falls below the feed pressure Pf (Q in (c) of the drawing). Consequently the second actuating valve 34 is opened ((d)), low-pressure fuel is introduced into the pressure chamber 18, main valve lifting is executed by the initial energy due to the high-pressure fuel inflow, and the main valve 11 is fully opened. At this time minute vibrations occur in the main valve 11 accompanying energy conversion between the liquid pressure in the pressure chamber 18 and the valve spring 16, but these are not on a level regarded as problematic. Then, when the electromagnetic actuator 61 is turned on with prescribed timing, the second actuating valve 34 is forcibly opened and the third actuating valve 30 is opened through the action of high-pressure fuel ((e)), so that the main valve 11 is closed.

Next, advantageous results of this aspect are explained in greater detail.

When main valve lifting is begun, the pressure of the pressure chamber 18 rises in proportion to the open-valve time of the balance valve 21. From the moment that the downward force represented by the product of this pressure and the cross-sectional area Ap of the piston 13 exceeds the sum of the set force of the valve spring 16 and the attractive force of the magnet 17, the main valve begins downward motion.

In the piston-valve motion system, the energy related to the main valve in a stationary state after being lifted to an arbitrary position is expressed by eq. (1), ignoring friction and the attractive force of the magnet 17.

$$mx+(1/2)Kx^2=PF_{in} \quad (1)$$

Here m is the equivalent mass, x is the main valve lifting amount, k is the spring constant of the valve spring 16, P is the pressure in the pressure chamber 18, and $F_{in}$ is the flow of fuel introduced into the pressure chamber 18.

The equivalent mass m and spring constant k are known constants. Hence when the pressure P can be regarded as constant, the lift amount x is a function of the fuel flow $F_{in}$ alone. In this aspect, by controlling the turn-on time of the electromagnetic solenoid 28, the valve-open time of the balance valve 21 can be changed continuously, and together with this the fuel flow $F_{in}$ can be controlled. Hence it is possible to freely control not only the main valve open/close timing, but the main valve lift amount x as well.

Next, when the main valve is in motion, the following continuous eq. (2) obtains for the pressure chamber 18.

$$F_{in}=Ap\cdot dx/dt+V_{cc}/K\cdot dP_{cc}/dt \quad (2)$$

Here $F_{in}$ is the fuel flow introduced into the pressure chamber 18, Ap is the cross-sectional area of the piston 13, x is the main valve lift amount, $V_{cc}$ is the capacity of the pressure chamber 18, K is the bulk modulus, and $P_{cc}$ is the fuel pressure.

From this equation, it is seen that while the main valve is falling, a drop in the pressure in the pressure chamber 18 occurs which is proportional to the main valve velocity dx/dt. When as a result of this drop in pressure the pressure in the pressure chamber 18 falls below the pressure of the low-pressure chamber 32, the second actuating valve 34 opens. As a result, low-pressure fuel is introduced into the pressure chamber 18 in an amount equivalent to the first term on the right in the above eq. (2), (piston cross-sectional area Ap)×(main valve lift amount x). As a result the main valve motion is not impeded. In general, the energy is the pressure times flow, as indicated by the right-hand side of eq. (1). The flow amount is determined uniquely when the piston cross-sectional area Ap and main valve velocity dx/dt are determined. Hence in order to reduce the energy loss, it is effective to utilize low pressures. This is the reason why this aspect the low-pressure fuel is introduced into the pressure chamber 18 during main valve lifting. By this means, unnecessary energy consumption can be reduced.

Next, when there is no inflow or outflow of fuel (pressure) in the pressure chamber 18, the stationary state of the main valve is maintained. As a result, the main valve can be held in an open state for a desired length of time, and can also be held in a partly open state.

However, when the engine is supercharged, if the main valve is an intake valve, a force acts on the main valve in the open-valve direction (downward) during main valve lifting. In order to avoid valve-opening action due to this force, normally the set force of the valve spring 16 must be made comparatively high. In this aspect, Fs is approximately 30 kgf. However, as a consequence the force in the closed-valve direction (upward) and the load are increased still more as the main valve is lifted, so that greater driving energy is required for main valve lifting.

Figure 10:
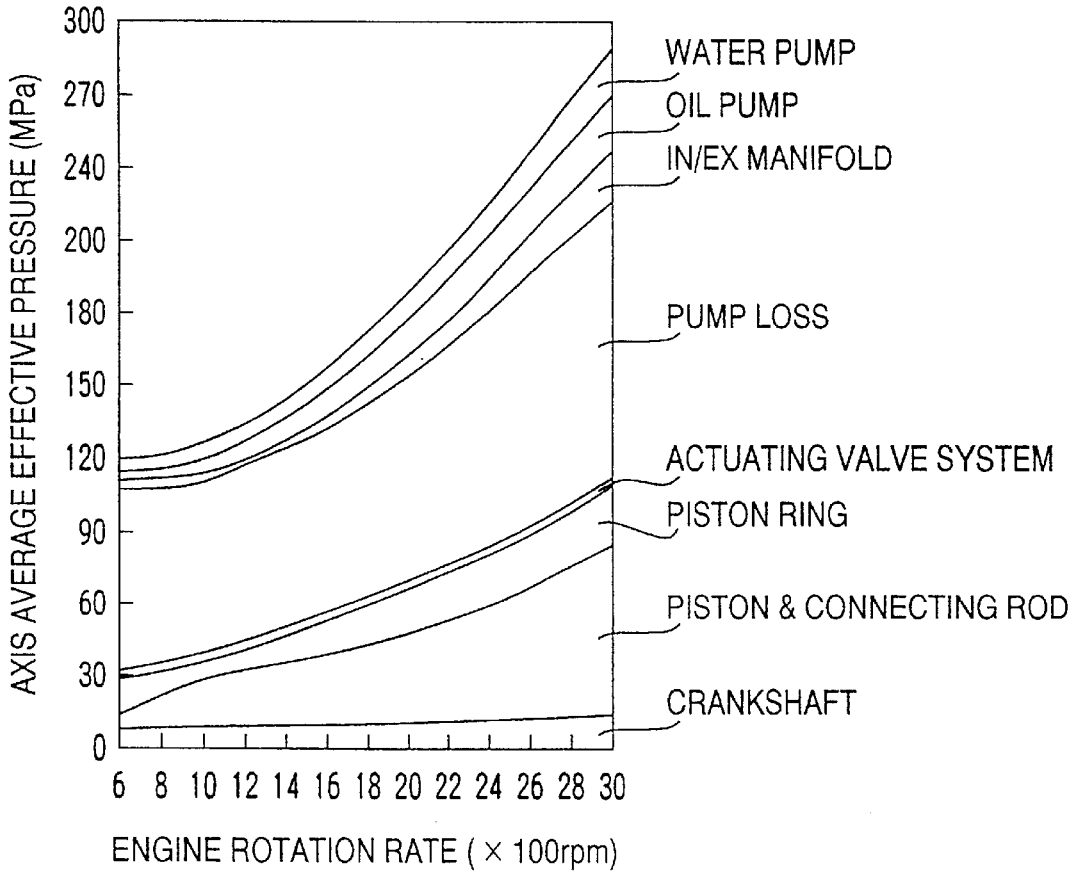
FIG. 10 is a graph showing friction losses in an ordinary cam-driven diesel engine.

In an ordinary cam-driven valve mechanism, a spring force presses on the cam face on the closed-valve side, so that there is action to recover energy and the energy for valve driving is minimal. FIG. 10 shows friction losses for each component in a diesel engine using such a valve mechanism; the vertical axis shows the axis average effective pressure. This is the negative work associated with friction loss, divided by the engine exhaust amount. The horizontal axis shows the engine revolution rate; that is, each fractional loss, as measured by the analytical friction method, is shown as a function of the engine revolution rate. From the results, the fraction of the total friction accounted for by the valve system is from 2 to 4%, and by multiplying this figure by the input energy, the energy required for driving of the valve system can be computed. As a result of calculations, the driving energy required per valve is found to be 1.65 J.

However, in a camless method such as that of this aspect, energy recovery is difficult. Hence ordinarily the valve driving energy of a camless method would be higher than that of a cam driving method, with possible adverse results for output and fuel efficiency.

Hence in this aspect, in addition to the valve spring 16, a magnet 17 is also used.

In general, the force Fm between magnets is expressed by eq. (3).

$$Fm=1/(4\pi\mu_0)\cdot qmqm'/r^2 \quad (3)$$

Here $\mu_0$ is the magnetic permeability, $q_m$ and $q_m'$ are magnetic charges, and r is the distance.

Hence in this case of this aspect, as the main valve is lifted, the force decreases in inverse proportion to the square of the distance between the magnet 17 and the flange portion 15. As a result, even when high lift is obtained, the energy for main valve driving is small, so that output and fuel efficiency are improved.

As seen from eq. (1), the driving energy is in theory determined by the product of the equivalent mass m and the main valve lifting amount x. The main valve lifting amount x is uniquely determined according to the engine performance, so that in order to reduce the driving energy, the equivalent mass m must be reduced. Here, the equivalent mass means the mass of the main valve itself, plus the load from the valve spring and similar. In actuality, because it is not possible to greatly reduce the mass of the main valve itself, in this aspect attention was focused on load components.

That is, the main valve must be supported by a high force of approximately Fs=30 kgf during valve-closing seating, in order that valve opening does not occur in response to supercharging pressure. If this force is provided only by the set load of an ordinary coil spring, of course the force (load) to hold the main valve in the open position will increase as the main valve is lifted. This is shown in FIG. 11; as indicated by the dot-dash line, as the main valve lifting (horizontal axis) increases, the force to hold the main valve open (vertical axis) increases.

On the other hand, a magnet has characteristics such that the force is attenuated in inverse proportion to the square of the distance, as shown by the solid line in the figure. Consequently in the case of this aspect, in which a magnet is used together with a valve spring, the valve-open holding force characteristic can be designed to be as shown by the dot-dot-dash line in the figure. Hence compared with a case in which only a valve spring is used, the valve-open holding force can be reduced, and consequently the driving energy is decreased.

Stated more simply, a valve spring (with an initial load of less than 30 kgf in the valve-closed state) which is weaker than the valve spring normally required (with an initial load in the closed state of 30 kgf or higher) is used, and the deficiency in the spring load is augmented by a magnet, so that when the main valve is closed the required load of Fs=30 kgf is always obtained. When the main valve is opened, on combining the spring the load of which tends to increase and the magnet the load of which tends to decrease as the lift amount increases, the minimum required load to close the main valve is secured, so that even as the lift amount increases the consumption of excessive driving energy can be avoided.

Figure 11:
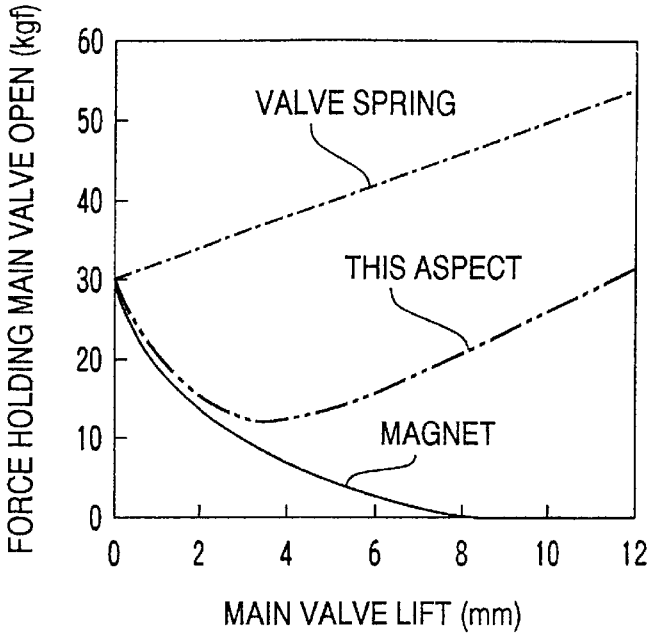
FIG. 11 is a graph comparing the open-valve holding force of a valve spring and magnet.
Figure 12:
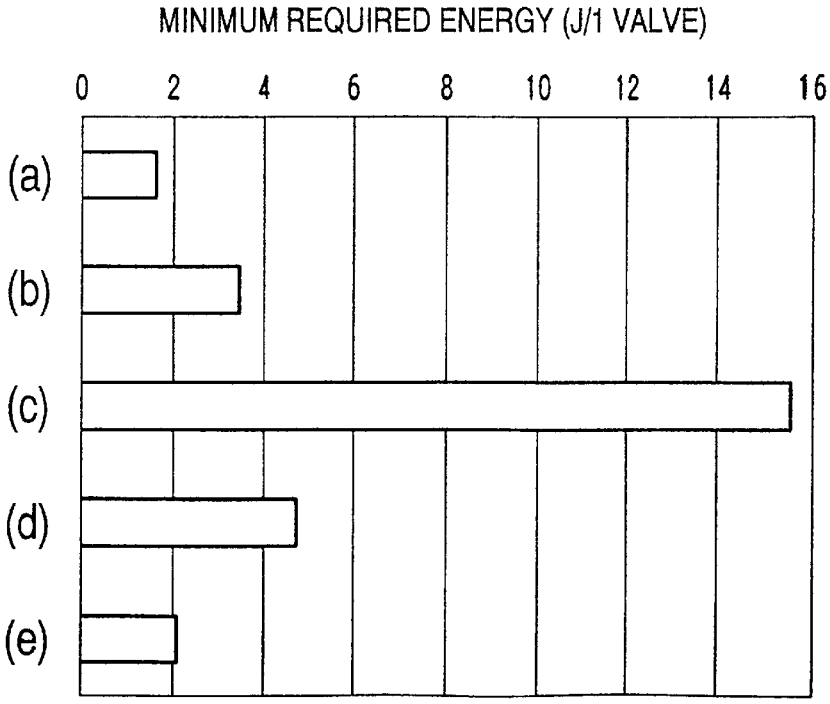
FIG. 12 is a graph comparing the energy necessary for maximum valve lifting.

FIG. 12 shows the results of calculations of the driving energy, based on the characteristics of the valve spring and magnet shown in FIG. 11 (with different absolute values). FIG. 12 shows the minimum energy required to lift one valve by a maximum lift amount $L_{max}$=11.8 mm (see FIG. 8).

As explained above, when using ordinary cam driving the driving energy is 1.65 J, as shown in (a). In contrast, in the case of a camless design in which the magnet 17 and low-pressure chamber 32 in this aspect are omitted and the force Fs=30 kgf during closed-valve seating is secured using only a valve spring, the higher energy of 4.85 J is required, as shown in (d). For reference, when the force Fs=30 kgf for closed-valve seating is secured using a hydraulic pressure of 4.43 MPa in place of a valve spring and magnet, in a camless method in which the driving energy is reduced by low-pressure introduction from the low-pressure chamber, the energy is 3.48 J, as in (b). If the hydraulic pressure is raised to 20 MPa, an extremely high energy of 15.67 J is necessary, as shown in (c). On the other hand, when a magnet is used and low pressure is introduced as in this aspect, the energy is greatly reduced to 2.1 J as in (e), comparable to an ordinary cam-driven design. The above results substantiate the superiority of this aspect.

When a magnet is not used, the closed-valve holding force Fs=30 kgf must be generated by another method. If a spring or hydraulic pressure is used, driving losses increase as explained above, and so these methods cannot be called effective. However, if these are used the device itself is functional.

As the magnet, in addition to a permanent magnet, an electromagnet or similar can also be used. However, a permanent magnet is preferable insofar as lower costs are incurred and the driving energy of electromagnet is not required.

Figure 13:
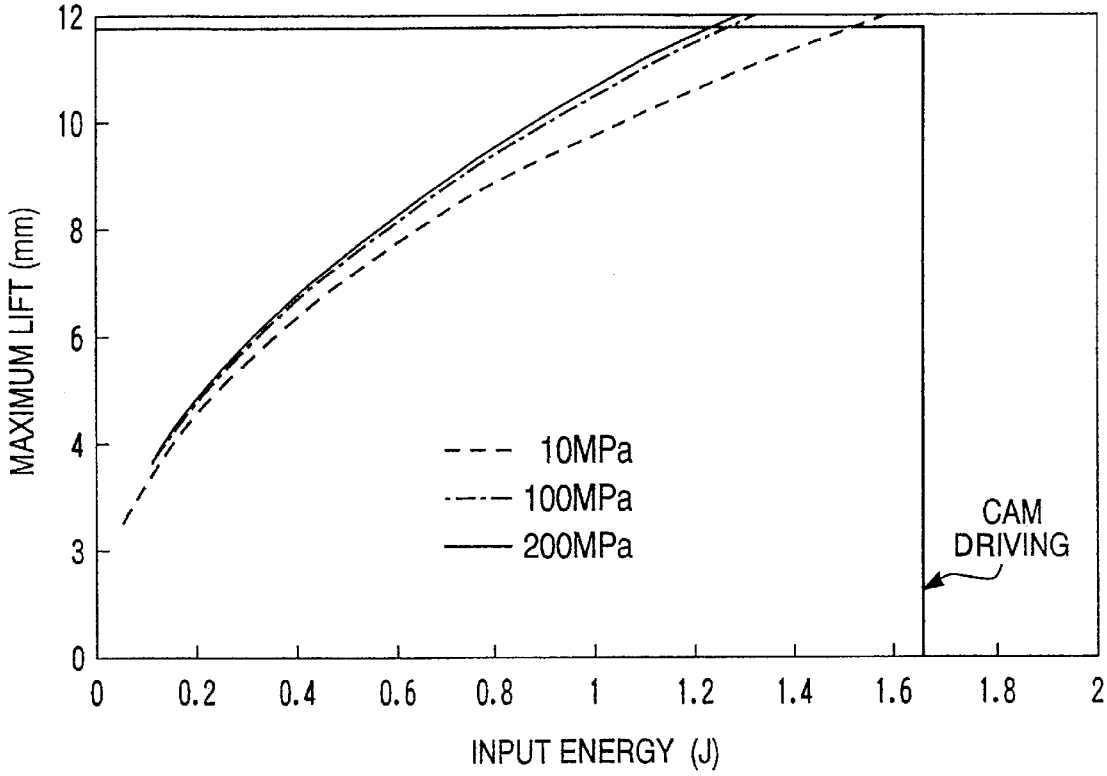
FIG. 13 is a graph comparing the valve driving efficiency at different high pressure values; and, FIG. 14 is a graph showing the results of studies of the effectiveness of low pressure use.

In this aspect, it is clear that the higher the pressure introduced into the pressure chamber 18, the higher is the efficiency. FIG. 13 shows the relation between the input energy (along the horizontal axis) and the main valve maximum lift (vertical axis), investigated with the pressure of the high-pressure fuel introduced into the pressure chamber 18 set to 10 MPa (dashed line), 100 MPa (dot-dash line), and 200 MPa (solid line). It is seen that the higher the pressure, the better is the efficiency. In ordinary cam driving, a maximum lift of $L_{max}$=11.8 mm is obtained at an energy of 1.65 J; a characteristic comparable to this is obtained even at 10 MPa. However, if the pressure is raised further, the energy necessary for the same lifting is reduced, and the energy efficiency can be improved. This aspect, which uses a common rail pressure as high as several hundred MPa, is in this sense extremely effective for reducing the driving energy. And because separate equipment to generate high pressure is not needed, the device can be simplified, contributing to cost reduction.

Figure 14:
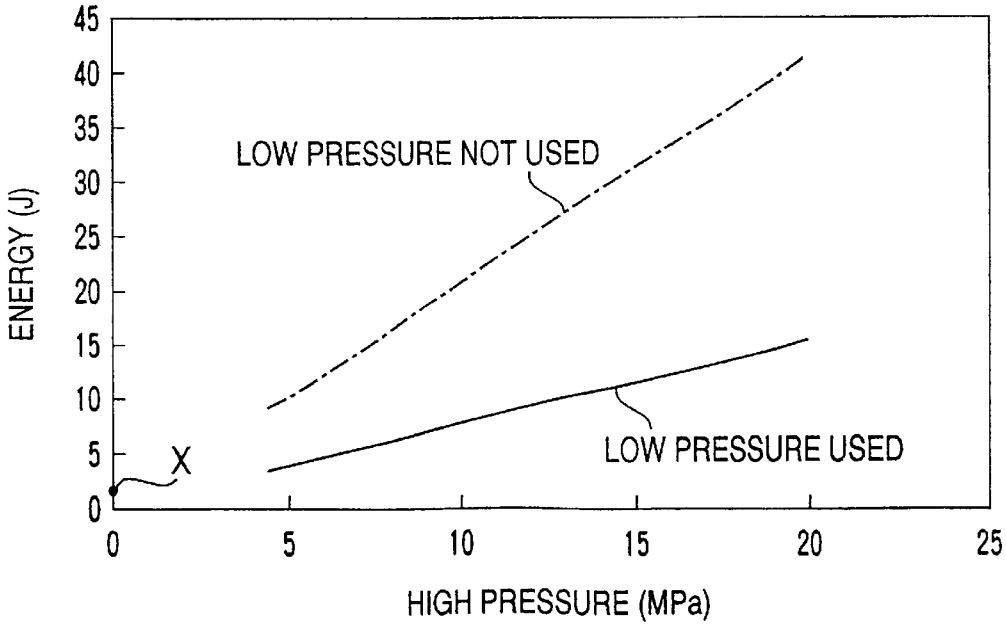

Next, the results of studies of the effectiveness of using low pressures in main valve lifting appear in FIG. 14. Here a device similar to that of this aspect is considered, and cases in which low pressure is introduced into the pressure chamber (low pressure used, solid line) and in which low pressure is not introduced (low pressure not used, dot-dash line) were studied. The energy (vertical axis) required to lift the main valve the maximum $L_{max}$=11.8 mm was studied as a function of the high pressure (vertical axis) introduced into the pressure chamber. In ordinary cam driving the energy required is 1.65 J, indicated by the X.

As is clear from the figure, when low pressure is used the energy needed is from ½ to ¼ that required when low pressure is not used. Thus the superiority of low pressure use is substantiated.

Further, this aspect has the following structural characteristic.

As shown in FIG. 1, in this aspect the piston 13 is not removed from the piston insertion hole 44, and the ratio of the increase in capacity of the pressure chamber 18 to the amount of movement of the piston 13 is held constant, during the interval from the time the main valve 11 is fully closed until it is fully opened. Hence all the energy associated with the pressure of the high-pressure fuel or low-pressure fuel introduced into the pressure chamber 18 can be converted efficiently into kinetic energy of the main valve 11, so that energy losses can be reduced and driving losses can also be decreased.

Conversely, if a construction were employed in which, during the change in the main valve 11 from fully closed to fully open, the piston 13 were to be removed completely from the piston insertion hole 44 and the cross-sectional area of the pressure chamber 18 were suddenly expanded, so that the ratio of the increase in volume of the pressure chamber 18 to the movement of the piston 13 increased at the instant in which the piston 13 were removed, then the pressure of the pressure chamber 18, which had thus far been satisfactorily increased, would be decreased from the instant of removal of the piston 13, and so would not be effectively converted into kinetic energy of the main valve 11. Compared with such a construction, the construction of this aspect enables effective utilization of the energy associated with pressure for motion of the main valve 11 during the interval from the fully-closed to the fully-open position of the main valve 11, and so is advantageous.

In this aspect, low-pressure fuel is directly introduced into the pressure chamber 18 from the low-pressure chamber 32 positioned on the outside of the actuator body 14, via the passage 31 formed by the dedicated hole provided within the actuator body 14 and similar. By this means, the channel for low-pressure fuel can be prevented from becoming excessive, low-pressure fuel can be introduced immediately, and controllability and response are enhanced.

In particular, there are only two passages connected to the pressure chamber 18, the outlet 41 and the passage 31, fewer than the three of the prior art. Consequently the capacity of the pressure chamber 18 can be minimized, and the energy supplied during driving to open the main valve can be reduced, while also increasing the available energy fraction which is the fractional conversion into main valve kinetic energy of the energy supplied when opening the main valve, so that the energy required to drive the main valve can be reduced, and output and fuel efficiency can be improved.

These advantages are due largely to the incorporation in one place of the second actuating valve 34 for low pressure introduction and the third actuating valve 30 for fluid discharge, and, in the example of FIG. 2 through FIG. 4, inclusion in a single valve unit 19. Much is also due to the adoption of the above-described configuration, enabling performance of various actions without impediment. In the above aspect, when the direction of flow from the pressure chamber 18 passing through the second actuating valve 34 is considered, the third actuating valve 30 is provided on the downstream side of the second actuating valve 34. By means of this positioning, the second actuating valve 34 and third actuating valve 30 can be operated without impediment.

Figure 5:
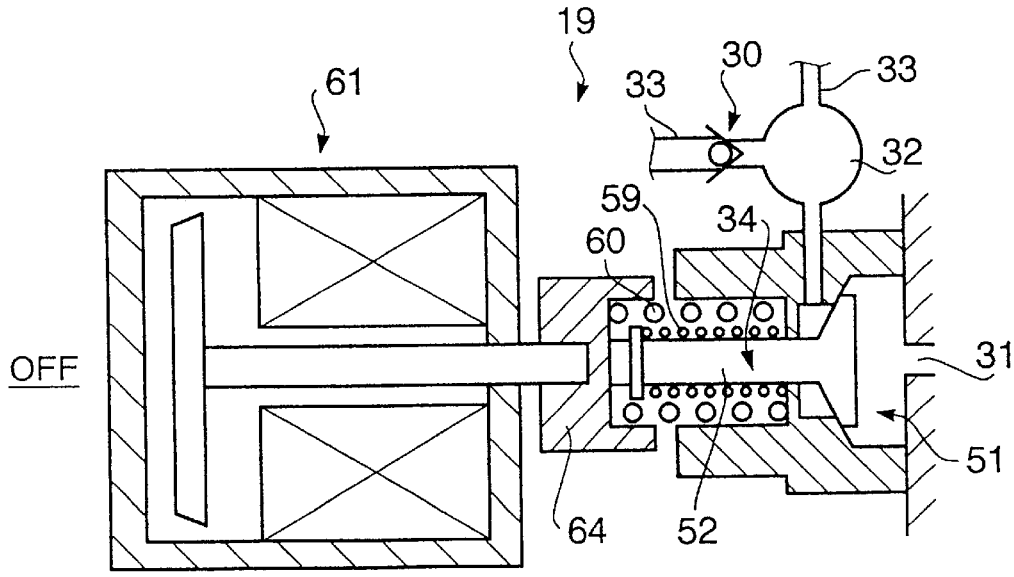
FIG. 5 is a cross-sectional view of principal components of a valve unit of another aspect, in which the electromagnetic solenoid is in the normal or off state.
Figure 6:
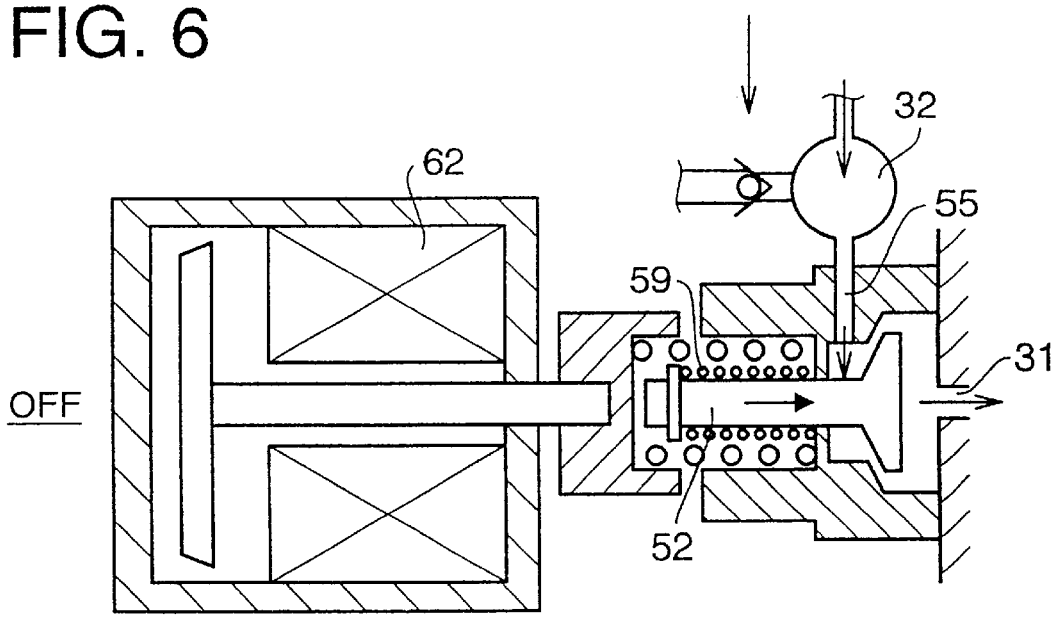
FIG. 6 is a cross-sectional view of principal components of a valve unit of another aspect, in the low-pressure introduction state.
Figure 7:
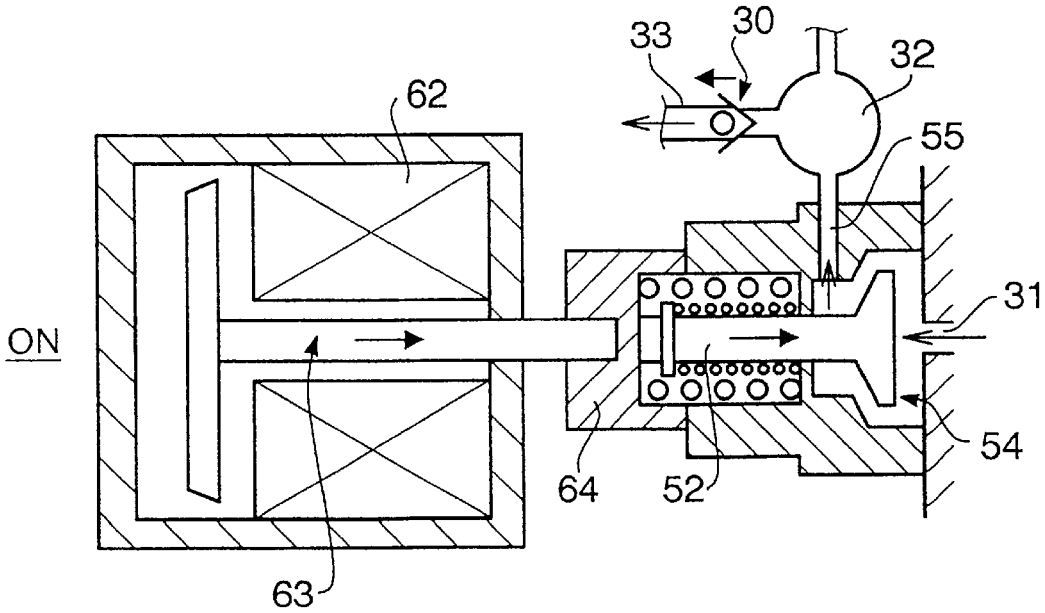
FIG. 7 is a cross-sectional view of principal components of a valve unit of another aspect, in the high-pressure discharge state.

Other aspects are shown in FIG. 5 through FIG. 7. Portions which are the same as in the above-described aspect are assigned the same symbols in the drawings, and detailed explanations are omitted.

As shown in FIG. 5, in this aspect the second passage 56 from the valve unit 19 and the third actuating valve 30 are omitted, and in their place a third actuating valve 30 is provided directly in the low-pressure chamber 32. The inlet to the third actuating valve 30 is connected to the low-pressure chamber 32, and the outlet of the third actuating valve 30 is connected to the feed path 33. In all other respects this aspect is similar to the above-described aspect.

FIG. 5 shows the turn-off state of the electromagnetic solenoid 62 of the valve unit 19, corresponding to FIG. 2. FIG. 6 shows the state of low pressure introduction into the pressure chamber 18, with the electromagnetic solenoid 62 similarly turned off, corresponding to FIG. 3. FIG. 7 shows the turn-on state of the electromagnetic solenoid 62, which is the state of fuel discharge from the pressure chamber 18, and corresponds to FIG. 4. At this time, high-pressure fuel which has flown into the valve chamber 54 from the pressure chamber 18 reaches the low-pressure chamber 32 via the first passage 55, presses and opens the third actuating valve 30, and is discharged into the feed path 33.

As is seen from this aspect, the third actuating valve 30 may also be provided in the first passage 55.

Various other aspects of this invention may be conceived. In the above aspects, the actuating fluid is taken to be engine fuel (light oil), the high-pressure actuating fluid is fuel at common-rail pressure, and the low-pressure actuating fluid is fuel at feed pressure; but ordinary oil or similar may be used as the actuating fluid, and the high and low pressures may be created by a separate hydraulic apparatus. However, in the case of a common rail diesel engine, the high pressure and low pressure are in any case generated by the fuel, and so utilization of these as described in the above aspect results in a simpler configuration and lower costs, and so is desirable.

In the above aspects, a valve spring and magnet are used in conjunction in order to impel the main valve in the closed-valve direction; however, use of a valve spring alone, or of a magnet alone, is conceivable. In the above aspects, a configuration was employed in which the flange portion 15 is attracted by the magnet 17, but such a configuration need not be adopted.

The internal combustion engine is not limited to a common-rail diesel engine, but may be an ordinary fuel-injection pump type diesel engine, gasoline engine, or similar. The first actuating valve is not limited to the above-described pressure-balance type control valve, but may be an ordinary spool type valve or similar. The first actuating valve 20 and the electrical actuator in the valve unit 19 are not limited to electromagnetic actuators using electromagnetic solenoids 28, 62, but may use piezoelectric elements, giant magnetostriction elements, or similar. However, it is desirable that these actuators have as fast an operating speed as possible, and it is desirable that the operating speed and responsiveness of each of the actuating valves be as high as possible.

By means of the above-described invention, the volume of the pressure chamber can be reduced and the energy supplied during driving to open the main valve can be decreased, while at the same time the available energy fraction during main valve opening can be increased, the main valve driving energy can be reduced, and output and fuel efficiency can be improved.

What is claimed is:

1. A valve driving device of an internal combustion engine, to drive the opening and closing of a main valve serving as an intake valve or an exhaust valve of said internal combustion engine, comprising:

a pressure chamber, to which is supplied pressurized actuating fluid in order to open said main valve;

a high-pressure actuating fluid supply source, connected to said pressure chamber;

a low-pressure actuating fluid supply source, connected to said pressure chamber;

a first actuating valve, provided between said pressure chamber and said high-pressure actuating fluid supply source, which is opened for a prescribed period in an initial opening period of said main valve, and which supplies high-pressure actuating fluid from said high-pressure actuating fluid supply source to said pressure chamber;

a second actuating valve, provided between said pressure chamber and said low-pressure actuating fluid supply source, comprising a check-valve which, after said prescribed interval in the initial opening period of said main valve has elapsed, is opened based on the pressure difference when the pressure of said pressure chamber falls below the pressure of said low-pressure actuating fluid supply source, and which introduces low-pressure actuating fluid from said low-pressure actuating fluid supply source into said pressure chamber;

a third actuating valve, provided between said second actuating valve and said low-pressure actuating fluid supply source or in said low-pressure actuating fluid supply source, comprising a check-valve which is opened when an inlet-side pressure is higher than a prescribed pressure setting which is higher than the pressure of said low-pressure actuating fluid supply source and is lower than the pressure of said high-pressure actuating fluid supply source, and by which means actuating fluid of said pressure chamber is discharged; and, an actuator, which forcibly opens said second actuating valve in order to close said main valve.

2. The valve driving device of an internal combustion engine according to claim 1, wherein said third actuating valve is provided between said second actuating valve and said low-pressure actuating fluid supply source; the second actuating valve and third actuating valve are comprised by a single valve unit; and said low-pressure actuating fluid supply source is connected to said valve unit.

3. The valve driving device of an internal combustion engine according to claim 1, wherein said second actuating valve comprises a valve body, moveable in the axial direction; a poppet valve portion which receives the pressure on the side of said pressure chamber and is pressed toward the closed-valve side is provided on one end of the valve body; and wherein said actuator comprises an electrical actuator which, when turned on, presses against the other end of said valve body to drive said valve body to the open-valve side.

4. The valve driving device of an internal combustion engine according to claim 1, wherein a valve stopper is provided which defines the maximum opening of said second actuating valve.

* * * * *